United States Patent [19]

Anderson

[11] 4,274,180

[45] Jun. 23, 1981

[54] JEWELRY CLUTCH

[75] Inventor: Olof V. Anderson, North Kingstown, R.I.

[73] Assignee: Auson Incorporated, Providence, R.I.

[21] Appl. No.: 49,340

[22] Filed: Jun. 18, 1979

Related U.S. Application Data

[62] Division of Ser. No. 903,484, May 8, 1978, Pat. No. 4,195,391.

[51] Int. Cl.[3] ..... A44B 9/00

[52] U.S. Cl. ..... 24/155 BR; 24/216

[58] Field of Search ..... 24/155 BR, 110, 136 A, 24/263 SN, 102 SL, 49 P, 216; 85/5 B; 403/369, DIG. 8

[56] References Cited

U.S. PATENT DOCUMENTS

| | | | |
|---|---|---|---|
| 1,002,632 | 9/1911 | Bodor | 24/155 BR |
| 1,025,722 | 5/1912 | Roberts | 24/155 BR |
| 1,472,681 | 10/1923 | Roy | 24/155 BR |
| 3,261,067 | 7/1966 | Ikeda | 24/155 BR |
| 3,947,930 | 4/1976 | Martens et al. | 24/155 BR |

FOREIGN PATENT DOCUMENTS

| | | | |
|---|---|---|---|
| 29321 | 11/1912 | United Kingdom | 24/155 BR |

*Primary Examiner*—Alexander Grosz
*Attorney, Agent, or Firm*—William Frederick Werner

[57] ABSTRACT

This invention relates to a jewelry clutch for securing articles together, the clutch including releasably connected male and female components. The male component comprises a pin and the female component comprises a retainer located in a carrier. The carrier is positioned in a housing for releasably clamping the pin. When joined, the pin cannot be separated from the retainer except by depressing the carrier into the housing.

1 Claim, 9 Drawing Figures

JEWELRY CLUTCH

BACKGROUND OF THE INVENTION

The present invention is a division of U.S. patent application Ser. No. 903,484 filed May 8, 1978, now U.S. Pat. No. 4,195,391 for a Jewelry Clutch.

STATEMENT OF INVENTION

This invention relates to jewelry clutches and more particularly to clutches constructed of very few, light weight, tiny in size ornamental in nature parts which act as clamps on necklaces, stick pins and the like.

The present invention relates as indicated to a fastening device which can be attached to an article of jewelry. As such, it must be extremely small and easily manipulated into gripping and non-gripping position by manual dexterity of the finger nails or finger tips. It must therefore be quickly and easily operated and be positive and foolproof in gripping or clasp position.

PRIOR ART

Prior art devices such as U.S. Pat. Nos. 1,002,632, 1,068,833 and 1,089,755 are designed as hat pin point guards and/or hat pin safety devices. Size is not a factor when a clasp is used on a hat pin as it would be as a clasp on a necklace worn around a lady's neck. Positive locking action is not as important in a hat pin guard as it is in a necklace clasp.

OBJECTS OF THE INVENTION

Accordingly, it is a principal object of the present invention to overcome the deficiencies of prior art construction.

Another object of the present invention is to provide a jewelry clutch or clasp with a new and novel movement in moving from gripping, to gripping release position and from gripping release, to gripping position.

Still another object of the present invention is to provide a jewelry clutch with a minimum of light weight, very small in size, positive acting, inexpensive, releasably connected components.

Other objects of the present invention will become apparent in part and be pointed out in part in the following specification and claims.

Figures 1, 2, 3, 4, 5, 6, 7, 8, 9:
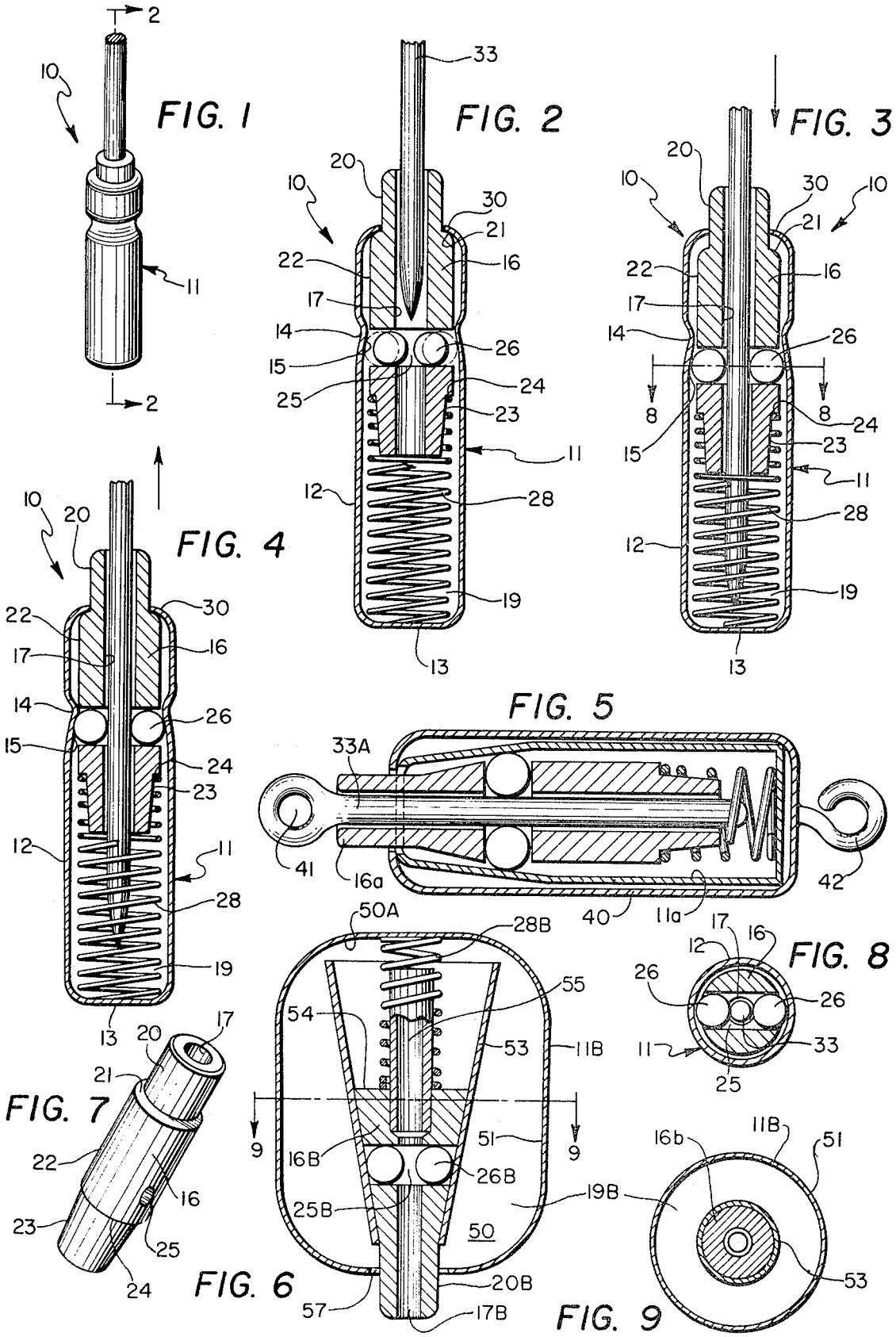
FIG. 1 is a perspective view of the new and improved jewelry clutch, enlarged many times.
FIG. 2 is a vertical, medial cross sectional view, taken on line 2—2 of FIG. 1, showing the gripping balls in free floating position.
FIG. 3 is a view similar to FIG. 2, showing the gripping balls in pin engaging but not pin locking position.
FIG. 4 is a view similar to FIG. 3, showing the gripping balls in pin locking position.
FIG. 5 is a vertical, medial cross sectional view, showing a modified form of construction.
FIG. 6 is a vertical, medial cross sectional view, showing a second modified form of construction.
FIG. 7 is a perspective view of the carrier.
FIG. 8 is a horizontal cross sectional view, taken on line 8—8 of FIG. 3.
FIG. 9 is a horizontal cross sectional view taken on line 9—9 of FIG. 6.

Referring to the drawings, the new and improved jewelry clutch, generally indicated by reference numeral 10, comprises a housing, generally indicated by reference numeral 11, fabricated as an elongated hollow tube having a side 12 and a base 13 closing one end of the hollow tube thereby forming an open ended chamber 19. Side 12 is provided with a recess 14 which forms an inclined wall 15.

A carrier 16 is provided with an axial bore 17. Externally, carrier 16 is provided with a reduced diameter or neck 20 which forms a shoulder 21 with the outside surface 22. A reduced area 23 on the end opposite the neck 20 provides a spring seat or ledge 24. A lateral passageway 25 in communication with said axial bore 17, provides a race for gripping devices or balls 26 axially aligned with said axial bore 17.

In assembling the clutch, a coil spring 28 is placed in chamber 19 with one end against base 13. Gripping devices or two balls 26 are placed in lateral passageway 25 and carrier 16 is placed in chamber 19 with ledge 24 abutting the other end of spring 28. Side 12 is bent inwardly to provide an annular flange 30 which engages shoulder 21 to secure carrier 16 within chamber 19. Coil spring 18 resiliently urges shoulder 21 against annular flange 30. Balls 26 are loosely mounted in lateral passageway 25. This structure constitutes the female component of the clutch. The male component is a pin 33 or any elongated projection which may be freely inserted into axial bore 11 (see FIG. 2) to a depth beyond gripping devices or balls 26 and in a manner to separate balls 26 (see FIG. 3). The balls 26 are of a size to engage side 12 when pin 23 separates balls 26. It will be noted in FIG. 3, that carrier 16 is depressed against the resistance of spring 28, with shoulder 21 removed from annular flange 30, in order to permit pin 33 to separate balls 26 and pass between them. Once pin 33 is within carrier 16, spring 28 (with manual pressure removed from carrier 16) will force carrier 16 in a direction away from base 12 so that shoulder 21 will engage flange 30. This condition is shown in FIG. 4, wherein pin 33 is fastened to carrier 16 through balls 26 when balls 26 engage inclined wall 15.

Manual pressure on neck 20 will force carrier 16 toward base 13 against the force of spring 28 whereby, balls 26 are free to roll toward side 12 because the balls will then be below inclined wall 15 as pin 33 is withdrawn or retracted from axial bore 17.

The modified form shown in FIG. 5 is substantially the same as the structure shown in FIGS. 1 through 4 with the exception that housing 11A is encased within a shell 40 with carrier 16A projecting beyond said shell 40. Pin 33A is provided with an eye 41 and shell 40 is also provided with an eye or hook 42. The structure functions in the manner previously described.

The second modified form shown in FIG. 6 comprises a housing 11B circular in cross section, (see FIG. 9) having a side wall 51 and end walls 50, 50A. Housing 11B is fabricated from two vertical half sections, fastened together, as by welding, to form a chamber 19B, as the final act of assembly. A circular tapered tube or rail 53 is fastened to one of the two half sections. A circular carrier 16B provided with a tapered side 52 which is complementary to the taper provided by circular rails 53, is provided with a neck 20B. Carrier 16B is also provided with an axial bore 17B, a lateral passageway 25B and a bottom 54. A hollow stem 55 is fastened to carrier 16B.

In assembling the clutch shown in FIG. 6, gripping devices or balls 26B are placed in lateral passageway 25B and a coil spring 28B is placed over stem 55. Carrier 16B is slidably mounted in rail 53 with one end of spring 28B against end wall 50A and the other end against bottom 54. Neck 20B lies in an aperture or orifice 57 formed in end wall 50 of both half sections and extends beyond housing 11B.

Neck 20B and therefore carrier 16B is manually depressable against the tension of spring 28B to allow balls or gripping devices 26B to slide along tapered side 53 to grip and ungrip pin 33 when it is slidably mounted in bore 17B.

Having shown and described preferred embodiments of the present invention by way of example, it should be realized that structured changes could be made and other examples given without departing from either the spirit or scope of this invention.

What I claim is:

1. A jewelry clutch comprising a housing circular in cross section and having oppositely located end walls, said housing fabricated from two vertical half sections fastened together to form a chamber, a circular tapered rail fastened to said housing within said chamber, a circular tapered carrier, said last mentioned taper being complementary to said first mentioned tapered rail and slidably mounted therein, said carrier having a neck, an axial bore, a lateral passageway, a bottom and a stem, or orifice in one of said oppositely located end walls, said neck projecting through said orifice, said lateral passageway aligned with said axial bore, a plurality of gripping devices located in said lateral passageway, a spring interposed between said bottom and the other of said oppositely located end walls, and a pin slidably mounted in said axial bore for engagement and disengagement with said plurality of gripping devices.

* * * * *